United States Patent [19]

Lagergren et al.

[11] 4,423,575

[45] Jan. 3, 1984

[54] DEVICE FOR FRAME PROFILES

[76] Inventors: Lars Lagergren, Stora Kvarngatan 49B, Malmö, Sweden; Wictor C. O. Lindström, Parkgatan 39D, Furulund, Sweden, 244 02

[21] Appl. No.: 288,756

[22] Filed: Jul. 31, 1981

[30] Foreign Application Priority Data

Aug. 14, 1980 [SE] Sweden ..... 8005739

[51] Int. Cl.[2] ..... E06B 1/04

[52] U.S. Cl. ..... 52/211; 52/214

[58] Field of Search ..... 52/280, 281, 210–214, 52/287, 288, 731, 732, 716–718, 242, 217

[56] References Cited

U.S. PATENT DOCUMENTS

| | | | |
|---|---|---|---|
| 1,229,765 | 6/1917 | Lehman | 52/287 |
| 3,585,768 | 6/1971 | Klein | 52/731 |
| 3,609,928 | 10/1971 | Mock | 52/214 |

FOREIGN PATENT DOCUMENTS

| | | |
|---|---|---|
| 146354 | 3/1913 | Canada . |
| 908985 | 10/1962 | United Kingdom . |
| 996639 | 6/1965 | United Kingdom . |

*Primary Examiner*—James L. Ridgill, Jr.

*Attorney, Agent, or Firm*—Schwartz, Jeffery, Schwaab, Mack, Blumenthal & Koch

[57] ABSTRACT

The present invention relates to a frame profile assembly for frame pieces or the like, wherein a first profile member is mounted to extend along an outer side of the frame piece and a second profile member is mounted to extend along an inwardly directed side of the frame piece adjacent the outer side. In order to permit quick and simple mounting of frame profiles and to eliminate the need for screw or nail mounting holes in the profiles, the frame profile members have cooperating coupling portions which connect the profile members to each other and which, together with hooked end portions adapted to hook onto one or more frame brackets, provide the only means to retain the frame profile in position, and also form a downwardly directed shield.

12 Claims, 1 Drawing Figure

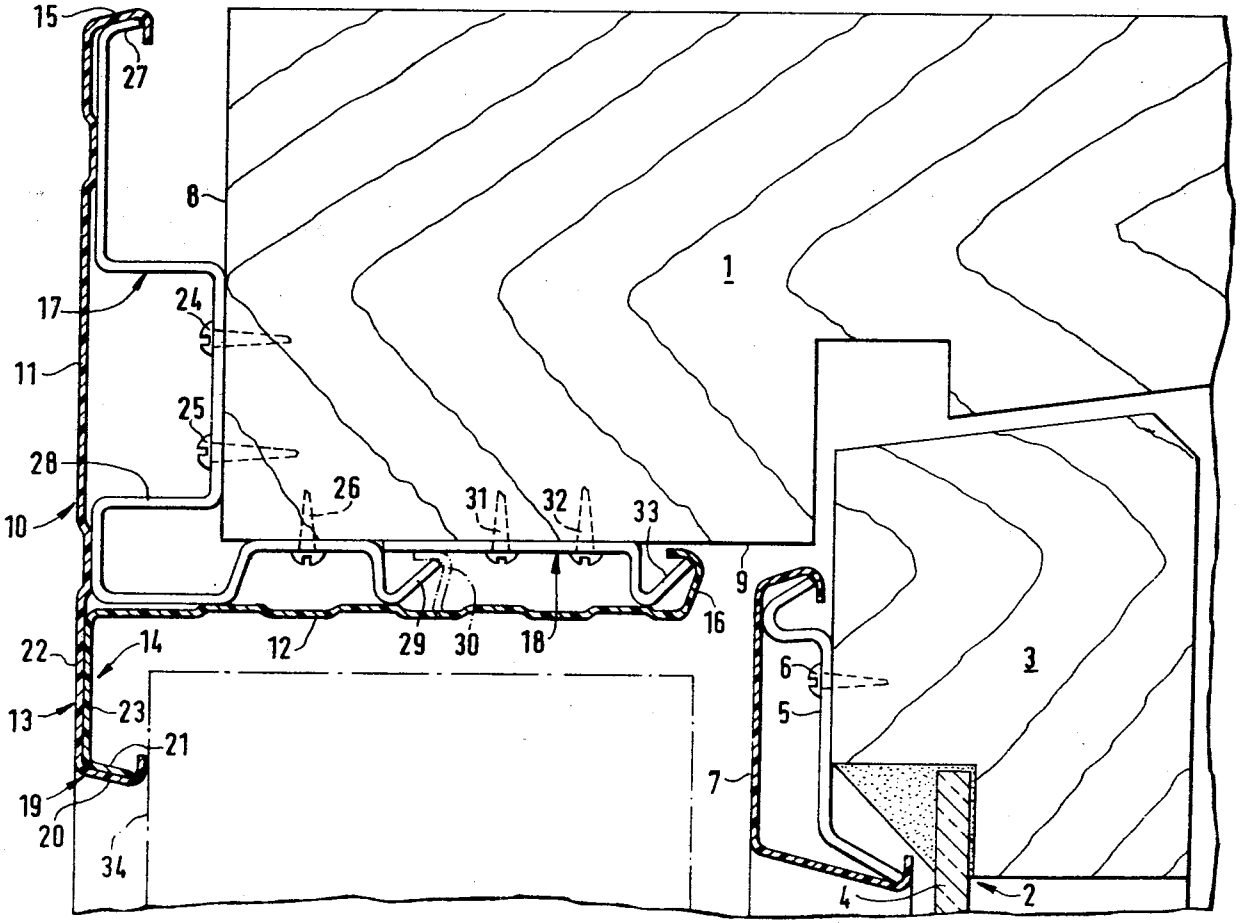
1
2
3
4
5
6
7
8
9
10
11
12
13
14
15
16
17
18
19
20
21
22
23
24
25
26
27
28
29
30
31
32
33
34

DEVICE FOR FRAME PROFILES

FIELD OF THE INVENTION

The present invention relates to a device for frame profiles of frame top pieces and frame side pieces, wherein each profile extends along an outer side of the frame and along an inwardly directed side of the frame which extends from the outer side.

BACKGROUND OF THE INVENTION

Frame profiles for frame top pieces are normally provided with hook portions as well as mounting holes. The hook portions are intended for hooking the frame onto a bracket and the mounting holes permit complementary fixation of the frame profiles by means of screws or nails. However, where the hook portions permit quick mounting, it generally requires a long time to screw in screws or to drive into the frame, especially since such fasteners might be difficult to reach with the required tools. Providing the profiles with mounting holes also requires extra working time and introduces a risk in that water may penetrate via the mounting holes under the profiles after the mounting.

SUMMARY OF THE INVENTION

The object of the present invention is to eliminate the above and other drawbacks inherent in prior art frame profiles. According to the invention this object is attained by means of profiles for frame top and side pieces where the profiles are constructed to extend along an outer side of the frame and along an inwardly directed side of the frame which extends from the outer side. The frame profile according to the invention comprises separate profile members each have cooperating coupling portions which connect the profile members to each other and which, together with hooked end portions of the profiles which hook onto respective brackets, provide the means to retain the frame profile in its proper position and form a shield.

DETAILED DESCRIPTION OF THE DRAWINGS

The invention will be further described below with reference to the accompanying drawing, which illustrates by a section a frame profile according to the invention mounted on a frame top piece.

The drawing shows a frame top piece 1 at a window structure with an inwardly opening window 2. The casement 3 of the window has a window pane 4 and brackets 5 mounted with screws 6 to lock casement profile 7.

In order to protect outer side 8 and the lower, inwardly extending side 9 of the frame top piece 1, a frame profile 10 is provided. The frame profile comprising two separate profile members 11 and 12 respectively, each having cooperating coupling portions 13 and 14 respectively, which, at one end, connect the profile members to each other and which at their other ends have hooked end portions 15 and 16 respectively, which are designed to hook onto one or more brackets 17 and 18 respectively. The coupling portions and hooked end portions provide the only means to retain the frame profile 10 in position. The hooked end portions 13 and 14 also form a downwardly directed shield 19. Thus an easily applied profile structure for a frame is provided, which eliminates the need for screw holes or other through openings in the profile and which has portions which simultaneously form a connection and a shield.

The coupling portions forming the shield 19 preferably comprise downwardly extending portion 13 of the profile member 11 and a hook portion 14 of the profile member 12, the hook portion engaging downwardly extending portion. Thus, a simple and efficient connection is obtained which is not visible from the outside.

The downwardly extending portion 13 may have an inwardly directed U-shaped end portion 20 and the hook portion 14 may be provided with an end edge 21 adapted to be received by the end portion 20. While the coupling portions 13, 14 further comprise support portions 22 and 23 respectively, extending parallel to and engaging each other, good stability is obtained without reinforcements in the form of separate reinforcement elements.

For permitting manufacture of the profile member 11 and/or the profile member 12 with the simplest tools, the profile member 11 may have symmetrically placed and/or symmetrically formed hook portions 15 and 20. Furthermore, the hook portion 16 of profile member 12 may have the same shape as the hook portions 15 and 20 of the profile member 11.

In the illustrated embodiment, bracket units 17 and 18 are used. The unit 17 is fastened with screws 24, 25 and 26 onto the frame top piece 1 and has a hook portion 27 for retaining the profile member 11 and a support portion 28 for supporting the profile members 11 and 12 adjacent the shield 19. The unit 17 engages the frame top piece 1 on both sides of the support portion 28 and has a second hook portion 29 for fastening short profile members (one hook portion 30 is shown with dotted lines). The other unit 18 is fastened with two screws 31, 32 to the top frame piece 1 and comprises a hook portion 33 for retaining the profile member 12. The exact position of this unit 18 is obtained by simply pushing it under the hook portion 29 of the bracket as far as possible.

The illustrated embodiment allows for covering the frame top piece 1 from the outside without the provision of moisture-preserving pockets. With only slight modifications, the profiles and/or the brackets described above may be used on frame top pieces of various configurations, while previously different brackets and profiles for various frame pieces had to be provided.

Since the profile members 11, 12 are made of resilient material, preferably elastic metal or plastic material, they may be pressed in position such that they snap over the hook portions 27, 33 of the bracket units 17, 18 respectively. The mounting is thus quick and easy and the profile members 11, 12 will remain tight after application. Also the mounting of the profile 34 (shown with dotted and dashed lines) for the frame side piece (not shown) is facilitated. In addition, a close fit between the profiles 10 and 34 is not required since the shield 19 covers any space between the profiles 10 and 34 from the outside.

The invention is not limited to the embodiment shown but may vary within the scope of the following claims. Thus, the profile 10 may consist of more than two profile members 11, 12 and the brackets of more than two units 17, 18.

What is claimed is:

1. A profile assembly for covering a frame piece having a corner comprising first and second adjacent sides, said assembly comprising:

at least one bracket adapted to be mounted on said frame piece;

at least two profile members adapted to be retained on said bracket and spaced from said sides of the frame piece;

a first of said profile members being adapted to extend along said first side and having first and second hook portions;

a second of said profile members being adapted to extend along said second side and having a first supporting portion adapted to project generally away from said second side and generally parallel to and in engagement with said first profile member along a second supporting portion thereof, said second profile member having a third hook portion;

said first supporting portion being operable to engage and grip said second supporting portion and said second hook portion and said first and third hook portions being operable to engage and grip said bracket whereby said profile members are securely retained together in a spaced relationship to said frame piece.

2. The profile assembly of claim 1, wherein said first profile member is generally U-shaped and said second profile member is generally S-shaped.

3. The profile assembly of claim 1, wherein said first and second hook portions are substantially U-shaped and extend in the same direction with regard to said first side, said second hook portion being disposed along an edge of said second supporting portion, and wherein said first supporting portion has an end portion which is operable to engage said second hook.

4. The profile assembly of claim 1, wherein said second supporting portion is an extension of said first profile member.

5. The profile assembly of claim 1, wherein said first and second hook portions are symmetrical with respect to each other.

6. The profile assembly of claim 1, wherein said first, second and third hook portions are of approximately the same size and shape.

7. The profile assembly of claim 1, wherein said first profile member is generally U-shaped and said second profile member is generally S-shaped.

8. The profile assembly of claim 1, wherein said first and second supporting portions cooperate to form a shield and wherein portions of said profile members adjacent to said shield are adapted to engage a support portion of said at least one bracket whereby said profile members are spaced from said frame piece.

9. The profile assembly of claim 8, wherein said at least one bracket comprises frame piece engaging portions adjacent to said support portion and a first bracket hook portion at an end thereof which is engaged by said first hook portion.

10. The profile assembly of claim 9, wherein said at least one bracket engages said profile members on either side of said frame engaging portions.

11. The profile assembly of claim 10, wherein said at least one bracket comprises two brackets, one of said brackets comprising a second bracket hook portion for engaging said third hook portion and the other of said brackets comprising a third hook bracket for engaging said first profile member.

12. The profile assembly of claim 9, wherein said at least one bracket comprises two brackets, one of said brackets comprising a second bracket hook portion for engaging said third hook portion and the other of said brackets comprising a third hook bracket for engaging said first profile member.

* * * * *